US005827155A

United States Patent [19]

Jensen et al.

[11] Patent Number: 5,827,155

[45] Date of Patent: Oct. 27, 1998

[54] RESILIENTLY MOUNTED TREADMILL

[75] Inventors: Jon F. Jensen, Providence; William T. Dalebout, Logan, both of Utah

[73] Assignee: ICON Health & Fitness, Inc., Logan, Utah

[21] Appl. No.: 303,434

[22] Filed: Sep. 9, 1994

Related U.S. Application Data

[63] Continuation of Ser. No. 13,748, Feb. 4, 1993, abandoned, which is a continuation-in-part of Ser. No. 884,609, May 15, 1992, Pat. No. 5,279,528, which is a continuation of Ser. No. 659,512, Feb. 21, 1991, abandoned.

[51] Int. Cl.[6] ..... A63B 22/02

[52] U.S. Cl. ..... 482/54; 267/160

[58] Field of Search ..... 482/32, 54; 267/41, 267/160; 248/617, 618

[56] References Cited

U.S. PATENT DOCUMENTS

| | | | |
|---|---|---|---|
| 1,064,968 | 6/1913 | Hagen | 482/54 |
| 3,709,197 | 1/1973 | Moseley | 482/54 X |
| 4,056,265 | 11/1977 | Ide . | |
| 4,350,336 | 9/1982 | Hanford . | |
| 4,423,864 | 1/1984 | Wiik | 482/54 X |
| 4,548,405 | 10/1985 | Lee et al. . | |
| 4,616,822 | 10/1986 | Trulaske et al. | 482/54 X |
| 4,886,266 | 12/1989 | Trulaske . | |
| 4,938,473 | 7/1990 | Lee et al. . | |
| 4,984,810 | 1/1991 | Stearns et al. . | |
| 5,029,801 | 7/1991 | Daleboot et al. | 482/54 X |
| 5,072,928 | 12/1991 | Stearns et al. . | |
| 5,074,550 | 12/1991 | Sloan . | |

FOREIGN PATENT DOCUMENTS

| | | | |
|---|---|---|---|
| 2616132 | 12/1988 | France | 482/54 |
| 1347953 | 10/1987 | U.S.S.R. . | |
| 9211905 | 7/1992 | WIPO | 482/54 |

*Primary Examiner*—Richard J. Apley
*Assistant Examiner*—John Mulcahy
*Attorney, Agent, or Firm*—Trask, Britt & Rossa

[57] ABSTRACT

A treadmill including an adjustable spring structure for providing resiliency or a cushioning effect to a user. The adjustable spring structure includes a longitudinally extending leaf spring secured at one end to a crossmember extending between the side rails of the treadmill frame, the free end of the leaf spring having secured thereto a downwardly extending foot. The flex of the leaf spring, and thus the resiliency or cushioning afforded the user, are adjustable via longitudinal movement of a laterally extending adjustment bar disposed between the leaf spring and the frame.

22 Claims, 4 Drawing Sheets

RESILIENTLY MOUNTED TREADMILL

This application is a continuation of application Ser. No. 08/013,748, filed Feb. 4, 1993, now abandoned, which is a continuation-in-part of U.S. application Ser. No. 07/884,609, filed May 15, 1992, now U.S. Pat. No. 5,279,528 which is a continuation of U.S. application Ser. No. 07/659,512 filed Feb. 21, 1991 and now abandoned.

BACKGROUND OF THE INVENTION

1. Field of the Invention.

The present invention relates generally to treadmills and, more specifically, to treadmills incorporating a structure for providing a resiliency or cushioning effect for a user striding on the treadmill deck.

2. State of the Art.

Typical treadmills include a continuous or endless belt trained about a pair of laterally extending rollers mounted to a longitudinally extending, rigid treadmill frame which usually consists of two laterally separated longitudinal members or rails linked together with two or more crossmembers. The upper stretch or run of the endless belt extends over a tread base or deck on which the user of the treadmill walks, jogs or runs. The base or deck is secured to the frame rails and the belt driven over and under the deck by rotation of one of the rollers, typically the front roller, which in turn is driven by an electric motor as known in the art. A column, pedestal or other structure extending upwardly from the frame at the front end of the treadmill is employed to support a console containing controls and readouts.

Many prior art treadmills may cause discomfort and even pain to the user due to the rigid and unyielding nature of the tread base or deck. The deck rigidity necessary to support the user as he or she strides on the endless belt is, upon prolonged use (either for an extended period of time or after regular daily use), uncomfortable to the user in the same manner as walking, jogging or running on an asphalt, cement or other hard surface for extended periods of time and/or distances. Stated another way, striding on a conventional, rigid, and rigidly mounted treadmill base or deck may jar the joints and tendons of the user, particularly at higher speeds and over longer distances and/or durations. Such a phenomenon is uncomfortable at the least and may, in fact, be detrimental for those using the treadmill for rehabilitative purposes.

Various arrangements have been proposed to provide a resiliency or cushioning effect for the treadmill user, including coil springs, pneumatic bladders or elastomeric shock absorption elements supporting the deck or even the entire treadmill, as well as resilient covers or coatings on the surface of the deck itself, and "deckless" treadmills having a spring-mounted belt much like a trampoline. Several of the aforesaid different cushioning arrangements are disclosed in parent U.S. patent application Ser. No. 659,512 filed on May 15, 1992, assigned to the assignee of the present invention, and incorporated herein by this reference.

Even with all of the proposed prior art solutions, there remains a need for a relatively simple, rugged and reliable structure to provide an easily-adjustable resiliency for a treadmill without adding significant cost, complexity and weight to the apparatus, and capable of being retrofitted to existing treadmills at reasonable cost and minimal effort.

SUMMARY OF THE INVENTION

The present invention comprises a treadmill incorporating an adjustable spring structure to provide a resiliency or cushioning effect to the treadmill user.

The treadmill of the present invention may be of standard construction in most respects, featuring the aforementioned longitudinally extending frame comprising two laterally spaced rails joined by cross members. The front of the treadmill, whereat the motor and control console are usually located, may be of fixed elevation or incorporate one of many inclination adjustment mechanisms known in the art. In either instance, the front of the treadmill frame is non-resiliently supported in the preferred embodiment of the invention. The rear of the treadmill frame includes a crossmember secured to and laterally extending between the frame rails, and having a leaf spring longitudinally extending therefrom and secured to the cross member at one of its ends. The other end of the leaf spring has a downwardly extending foot secured to it and on which the rear of the treadmill is supported. The longitudinal offset between the crossmember and the foot permits the leaf spring to flex under the weight and movement of the treadmill user. The resiliency of the leaf spring is preferably adjustable, and the adjustment may be effected via the longitudinal repositioning of an adjustment bar or rod extending laterally between the frame rails. In the preferred embodiment, the bar or rod is repositioned by rotation; that is to say, it is rolled forward or backward between the frame rails and the leaf spring. Rotation is facilitated by the lateral extension of the bar or rod beyond one side of the frame and attachment to that end of a hand wheel for easy grasping or rotation by the hand of the user. In order to ensure that the longitudinal position of the adjustment bar or rod remains fixed unless the hand wheel is rotated, the exterior of the bar or rod is provided with grooves or other elements which cooperate with mating elements, such as laterally extending, longitudinally spaced ridges on the treadmill rail bottoms or strips attached thereto. Travel of the bar or rod is limited by the extension of the band wheel end thereof through a longitudinal side window in a fairing surrounding the spring structure.

It is also contemplated that the adjustable spring structure of the present invention may be produced as a self-contained unit capable of being secured to the underside of an existing treadmill by drilling several holes in the frame rails or an existing cross member. Alternatively, treadmills may be initially produced with factory-predrilled holes in appropriate locations, and the spring structure of the present invention sold as an aftermarket accessory for attachment by the user.

In addition to the foregoing embodiments of the invention which employ a leaf spring, it is also contemplated that other types of springs and associated structure may be employed to resiliently mount a treadmill on a support surface.

BRIEF DESCRIPTION OF THE DRAWINGS

The present invention will be more fully understood by one of ordinary skill in the art through a review of the following detailed description of the preferred embodiments in conjunction with the accompanying drawings, wherein.

DETAILED DESCRIPTION OF THE PREFERRED EMBODIMENTS

Figure 1:
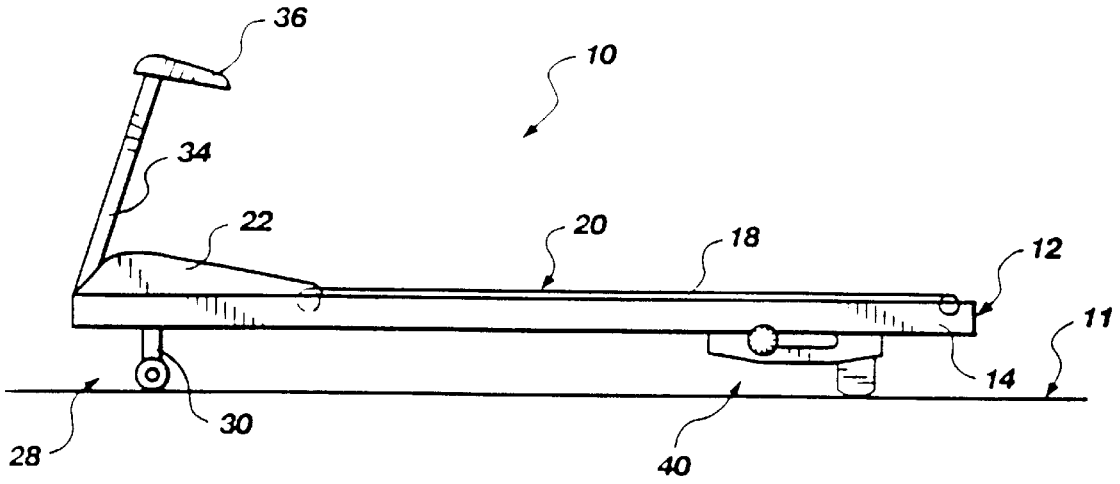
FIG. 1 comprises a schematic side elevation of a treadmill according to the present invention.

FIG. 1 of the drawings depicts treadmill 10 of the present invention standing on a support surface 11 such as a floor. Treadmill 10 includes frame 12 defined by two side rails 14 and 16 (the latter not shown in this view), surmounted by deck or tread base 18 over which endless belt 20 moves from the front of treadmill 10 toward the rear thereof. If desired an electric motor, hidden by hood 22, may drive front roller 24, with rear roller 26 being free-wheeling. Alternatively, both rollers 24 and 26 may be free-wheeling and belt 20 may be driven by the treadmill user. Front frame support structure 28 is shown in FIG. 1 by way of example as a fixed subframe 30 having wheels 32 at the lower extent thereof. Column 34 extends upwardly at the front of treadmill 10, supporting console 36 carrying controls and readouts. The adjustable leaf spring frame support structure 40 employed in the present invention is shown in FIG. 1 deployed toward the rear of treadmill 10.

Figure 2:
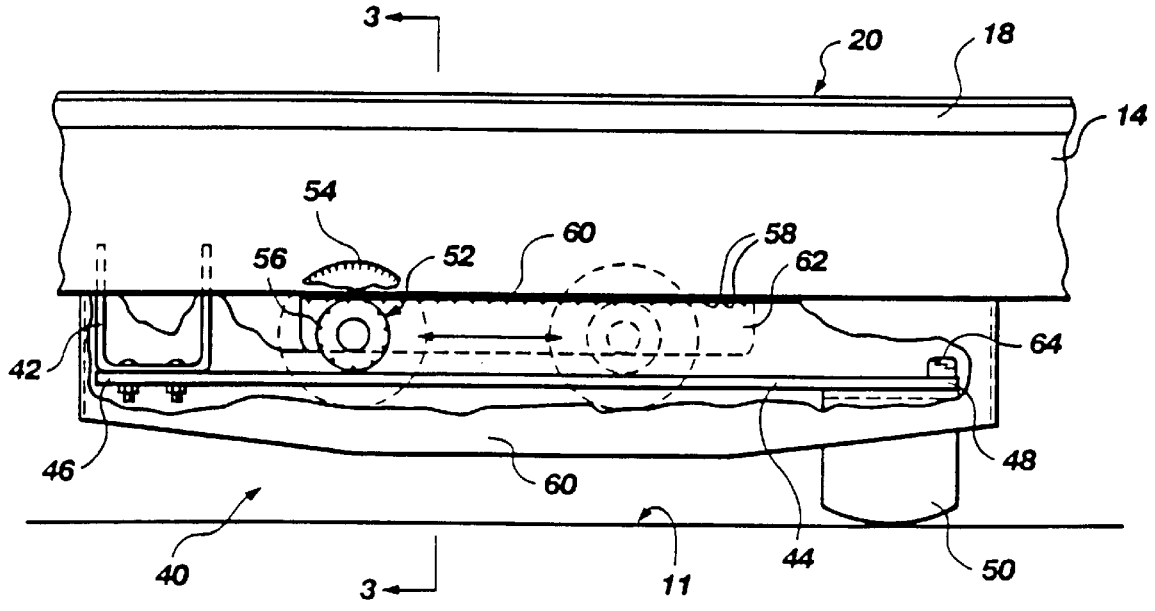
FIG. 2 comprises an enlarged side elevation of the adjustable leaf spring frame support structure employed in the treadmill of the present invention.
Figure 3:
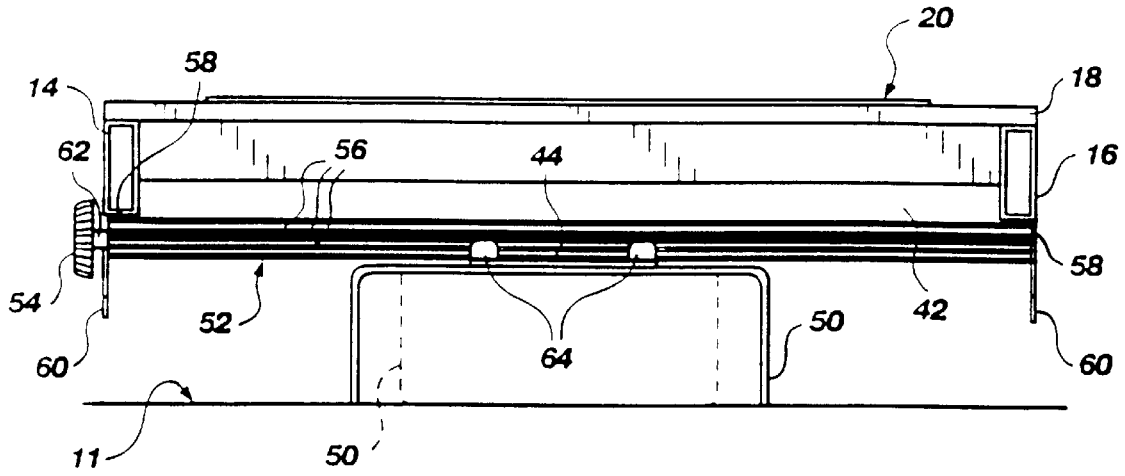
FIG. 3 comprises an enlarged rear elevation of the adjustable leaf spring frame support structure depicted in FIG. 2, taken along line 3—3.

As more clearly shown in FIGS. 2 and 3 of the drawings, structure 40 includes a crossmember 42, which may comprise a steel U-channel as shown, a box beam, I-Beam or other rigid crossmember 42 capable of supporting the rear of the treadmill with the user thereon. Crossmember 42 is secured at each end to a frame rail 14 and 16, typically by welding, although other means of attachment known in the art may certainly be employed. Leaf spring 44 is attached at one of its ends 46 to crossmember 42 proximate the midpoint of the latter by screws, bolts, spot or bead welds, or other means known in the art, and extends longitudinally rearward from crossmember 42. The other, free end 48 of leaf spring 44 has secured thereto a downwardly-extending foot 50, which rests on the floor supporting treadmill 10. Foot 50 may comprise an inverted U-shaped steel element (see FIG. 3) secured at the base of the "U" to free end 48 of leaf spring 44, or may comprise a plastic or elastomer block as depicted in broken lines and designated as 50'.

Round adjustment bar 52 extends from one side of treadmill frame 12 to the other, under both frame rail 14 and frame rail 16, and extends beyond frame rail 14 to terminate at hand wheel 54. The exterior of adjustment bar 52 includes a plurality of evenly circumferentially spaced, axially-extending grooves 56 preferably of a U- or V-configuration. Grooves 56 matingly engage evenly-spaced ribs or ridges 58 disposed on strips 60 attached to the undersides of rails 14 and 16. With this arrangement, rotation of hand wheel 54 and thus of adjustment bar 52 will cause bar 52 to move toward the front or rear of the treadmill (depending on direction of rotation) without slippage, due to the engagement of ribs or ridges 58 with grooves 56. Similarly, adjustment bar 52 will stay in position, due to the aforementioned engagement, when the treadmill is being used and the rear end thereof moves up and down as spring 44 flexes. If desired, grooves 56 may only extend axially along the portions of adjustment bar which engage ribs or ridges 58. Fairing 60 having window 62 in the side thereof adjacent frame rail 14 surrounds or encompasses structure 40, and may be secured to crossmember 42, frame rails 14 and 16, or to both. The end of adjustment bar 52 having hand wheel 54 attached thereto protrudes through window 62 of fairing 60, which limits the forward and rearward travel of adjustment bar 52, the rest of the structure 40 is being contained within fairing 60 for aesthetics and safety reasons.

The top of the free end 48 of leaf spring 4 has one or more elastomeric bumpers 64 secured to the top thereof to prevent damages to the underside of the treadmill deck 18, should the latter be contacted by leaf spring 44 under the weight of a larger user or under more violent running or jogging, or should leaf spring 44 be inadvertently adjusted by the user to too soft a setting.

In operation, the adjustable leaf spring frame support structure of the present invention is set to the desired resiliency, given the weight of the intended user and the nature of the intended exercise on treadmill 10 (walking, jogging, running). If adjustment bar 52 is rotated so as to be longitudinally repositioned proximate the free end 48 of leaf spring 44, spring 44 will offer virtually no flex and thus a minimum of resiliency and cushioning. On the other hand, movement of adjustment bar 52 to its forwardmost position will permit leaf spring 44 to flex significantly, providing the maximum resiliency and cushioning effect for the user.

FIGS. 2 and 3 depict structure 40 in terms of a single preferred embodiment, but it should be appreciated that the invention is not so limited.

Figure 4:
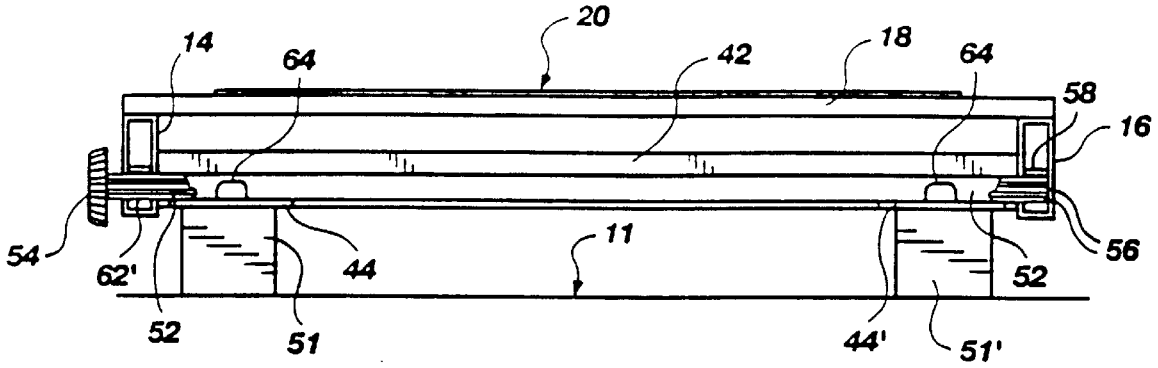
FIG. 4 comprises an enlarged rear sectional elevation of an alternative embodiment of the invention.

For example, as shown in FIG. 4, two outboard leaf springs 44 and 44' might be employed rather than a single, centrally located spring 44 and, as also shown, the spring or springs may be made integral with crossmember 42. Further, as also shown in FIG. 4, the adjustment bar 52 may extend through a window 62' in the frame itself, thus making the entire structure 40 move more compact vertically. Fairing 60 may be eliminated entirely or merely comprise an abbreviated skirt below the frame rails. Feet 51 and 51' may comprise separate elements or the downwardly-bent free ends of springs 44 and 44'.

Figure 5:
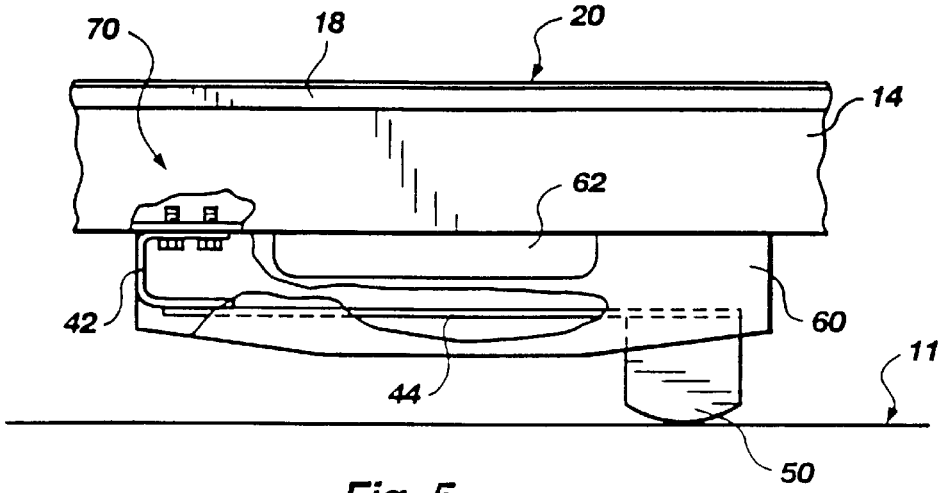
FIG. 5 comprises an enlarged side elevation of an alternative unitary or self-contained embodiment of the invention.

As shown in FIG. 5, a different fairing configuration 60' incorporating crossmember 42 might be employed, such a design making structure 40 essentially unitary and capable of being secured to the underside of treadmill frame 12 via bolts and predrilled holes, generally designated as 70. Such a configuration lends itself to sale of the spring structure as an aftermarket accessory for attachment to the treadmill by the ultimate user, as well as to more compact packaging even if initially sold with the treadmill.

Adjustment bar 52 could be made slidably, rather than rotatably, repositionable. Leaf spring 44 could be reoriented so that its free end 48 extends toward the front of frame 12. Further, although not as desirable from a cost or ease of adjustment standpoint, the crossmember 42 with leaf spring 44 attached could be made longitudinally slidable with respect to a fixed adjustment bar 52.

In addition to the foregoing embodiments, it is contemplated that an air spring may be employed to support the rear portion of treadmill frame 12 either by direct interposition between frame 12 and a supporting surface, or in combination with a pivotally mounted, articulated support structure.

Figure 6:
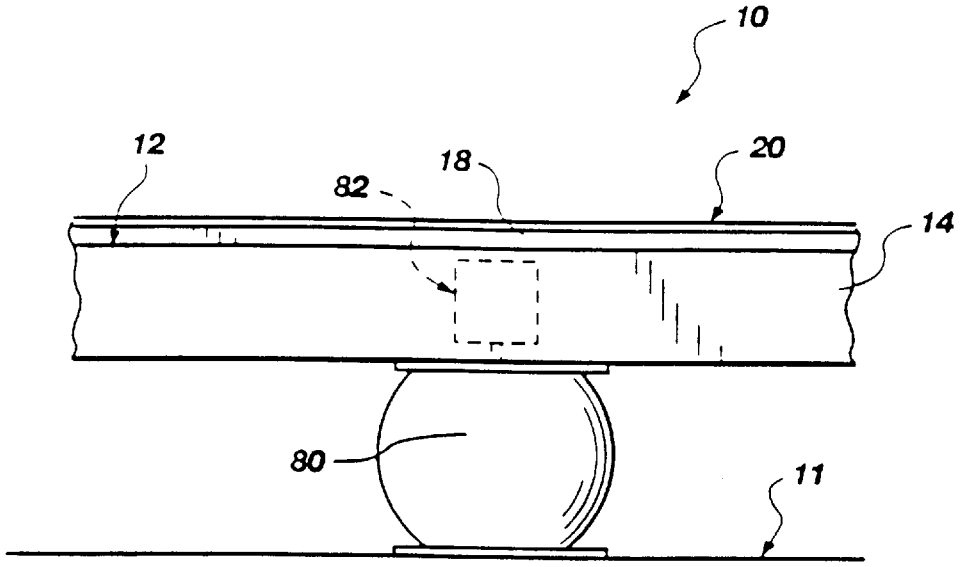
FIGS. 6 and 7 comprise enlarged side sectional elevations of alternative embodiments of the invention employing air springs.

FIG. 6 depicts treadmill 10 having one or more air springs 80, such as is commercially available from the Goodyear Tire and Rubber company, secured to the bottom of frame 12 in lieu of leaf spring frame support structure 40 and inflatable with air pump 82 via hose or tubing 84. In such an arrangement, treadmill 10 is resiliently supported on air spring 80, and the degree of resiliency adjusted by inflating or deflating air spring 80 to the desired air pressure.

Figure 7:
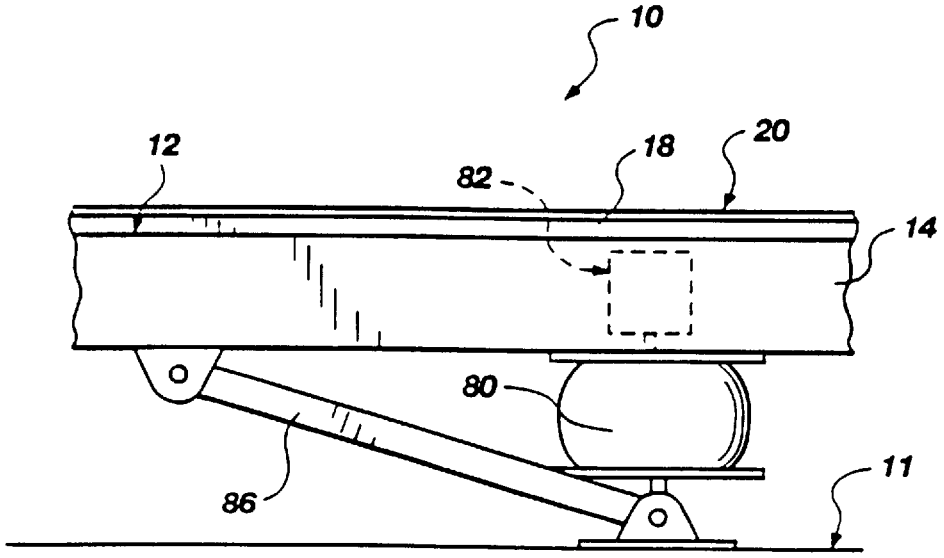

In the embodiment of FIG. 7, an air spring 80 is again employed but in conjunction with a pivotally mounted, articulated support structure 86.

Air springs 80 in either embodiment may be inflated or deflated by any means known in the art, such as manual or electric pumps and manual or remote-control valves.

Figure 8:
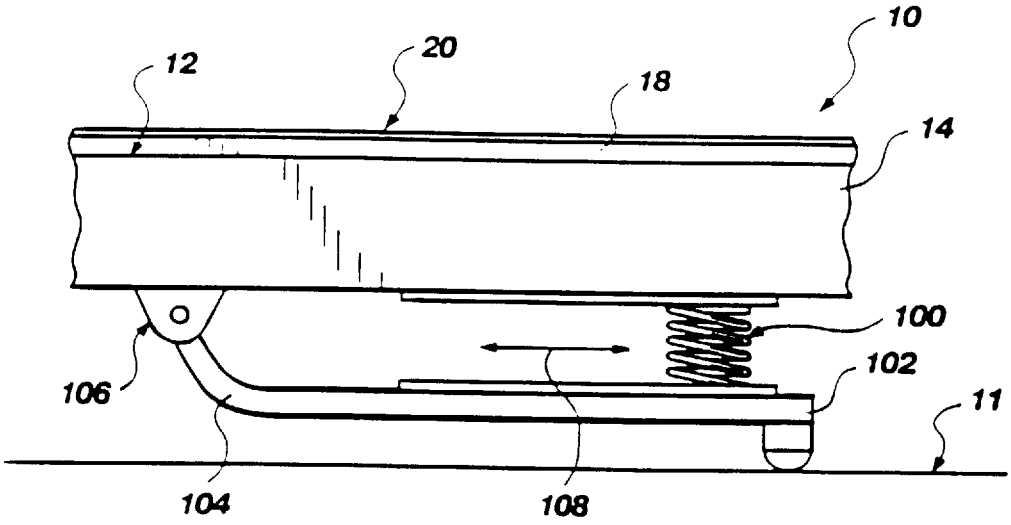
FIGS. 8 and 9 comprise enlarged side sectional elevations of alternative embodiments of the invention employing coil springs.

FIG. 8 depicts treadmill 10 having a coil spring 100 disposed between frame 12 and the free end 102 of elongated support member 104, which is hinged at 106 to frame 12. Alternatively, support member 104 may be fixed to said frame 12 and possess sufficient resiliency to flex under load to simulate a hinged connection. Foot 50 is secured to and extends downwardly from free end 102. Coil spring 100 may be mounted so as to be longitudinally movable in directions 108 to alter the effective length of support member 104 and thus the degree of resiliency experienced by a user supported on the treadmill 10, or may encompass an auxiliary air spring 80 therewithin to supplement the support given by the coil spring 100. It should be understood that two support members 104 may be employed, one at each side of frame 12, or a single, central support member 104 may be used. Alternatively, two hinged side support members 104 in combination with a crossmember to which one or more springs 100 is secured may be employed.

Figure 9:
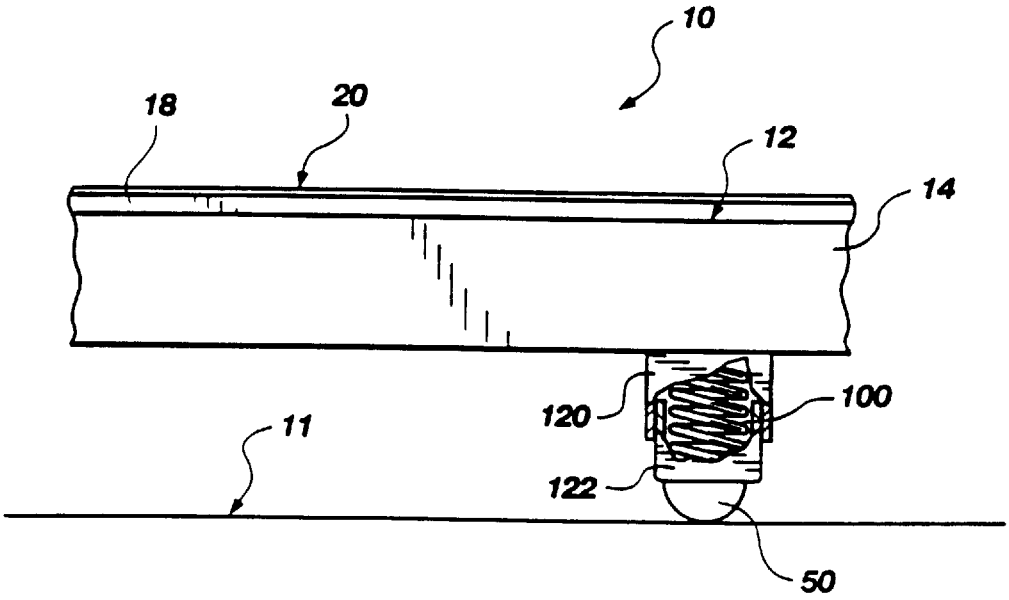

FIG. 9 depicts treadmill 10 having a tubular spring housing 120 extending downwardly from frame 12, encompassing a coil spring 100 having a foot 50 secured to the lower end thereof. If desired, foot 50 may be secured to the bottom of a tubular lower spring housing 122, as shown, which telescopes with spring housing 120. As with the embodiment of FIG. 8, an air spring 80 may be disposed within coil spring 100 if desired. Further, a spring housing and spring may be associated with each side of treadmill frame 12, or a single, central housing and spring employed with appropriate associated structure to prevent frame 12 from tilting to the side.

The spring means employed in the invention may comprise one or more leaf springs, coil springs, Belleville springs, or air springs, a hydraulic system such as a motorcycle shock absorber or other dashpot-type system, a sealed or variable pressure bladder, either with an empty interior or filled with a foam, or a soft rubber pad or bushing. Several types of springs, as noted above, may be employed in combination. As implied, the cushioning system may be of fixed or variable resiliency.

While the present invention has been described in terms of certain exemplary embodiments, it will be readily understood and appreciated by one of ordinary skill in the art that it is not so limited, and that many additions, deletions and modifications to the disclosed embodiments may be made within the scope of the invention as hereinafter claimed. For example and not by way of limitation, a spring and foot might be secured directly to each of the frame rails or side members instead of to a crossmember extending therebetween. Further and in lieu of using an adjustment bar, the foot at the free end of the leaf spring might be adjustably movable along the length thereof in order to effectively vary the length, and thus the flex, of the spring to adjust the cushioning effect of the spring.

What is claimed is:

1. A stationary treadmill having a portion thereof resiliently supported above a surface upon which said treadmill rests during exercise by a user, said stationary treadmill comprising:

a longitudinally extending frame supporting an endless belt trained about a pair of rollers, said endless belt including an upper stretch:

leaf spring means having one end thereof secured to a portion of said frame and a second unsecured end for flexibly, resiliently supporting a portion of said frame above said surface, said leaf spring means being flexible from a first undeflected position and a second deflected position spaced from said first undeflected position, said leaf spring means extending substantially horizontally with respect to the portion of said frame where said one end of said leaf spring means is secured, the use of said treadmill during said exercise by a user causing said leaf spring means to flex from said first undeflected position to said second deflected position;

a foot means secured to said second unsecured end of said leaf spring means extending substantially downwardly therefrom for supporting said leaf spring means above said surface; and wherein said leaf spring means and said foot means secured to said second unsecured end of said leaf spring means resiliently support said portion of said treadmill on said surface during said exercise by a user.

2. The apparatus of claim 1, further including means for adjusting the flexibility of said leaf spring means.

3. The apparatus of claim 1, wherein said treadmill frame includes first and second longitudinally extending and laterally separated frame rails, and said leaf spring means is secured to a laterally oriented crossmember extending between and secured to both of said frame rails.

4. A resiliently mounted treadmill for use during exercise by a user, said treadmill having a portion thereof being resiliently supported by a surface upon which said treadmill rests during said exercise by a user, said treadmill comprising:

a longitudinally extending frame including first and second longitudinally extending and laterally separated frame rails, a laterally oriented crossmember extending between said first and second longitudinally separated frame rails and secured thereto, said first and second longitudinally extending and laterally separated frame rails supporting a first roller, a second roller, a deck extending between the first and second rollers,and an endless belt trained about the first and second rollers, said endless belt including and upper stretch supported by the deck;

leaf spring means having a first end thereof secured to the laterally oriented crossmember extending between the first and second frame rails and a second unsecured end for flexibly supporting said frame, said leaf spring means being longitudinally oriented, centrally disposed between and below said frame rails, said leaf spring means being flexible between a first undeflected position and a second deflected position spaced from said first undeflected position;

adjustment means for adjusting the flexibility of said leaf spring means comprising a laterally oriented adjustment bar disposed between said leaf spring means and said frame rails, said adjustment bar being longitudinally repositionable between said crossmember and said second unsecured end of said leaf spring means;

a foot secured to said second unsecured end of said leaf spring means for supporting said leaf spring means above a surface; and wherein said leaf spring means and said foot secured to said second unsecured end of said leaf spring means resiliently support said portion of said treadmill on said surface during said exercise by a user.

5. The apparatus of claim 4, wherein said adjustment bar is of circular cross section and longitudinally repositionable via rotation.

6. The apparatus of claim 5, wherein said adjustment bar extends laterally beyond one of said frame rails, and further including hand wheel means secured to said lateral extension for grasping by the user and rotation of said adjustment means.

7. The apparatus of claim 6, further including first engagement means on the exterior of said adjustment bar proximate said frame rails, and second engagement means cooperable with said first engagement means and associated with said frame rails to effect said longitudinal repositioning of said adjustment bar in response to said rotation.

8. The apparatus of claim 7, wherein one of said first and second engagement means comprises evenly spaced grooves, and the other of said first and second engagement means comprises cooperating ribs spaced at distances equal to those of said grooves.

9. The apparatus of claim 8, wherein said grooves are disposed on the exterior of said adjustment bar, and said ribs are disposed on the undersides of said frame rails.

10. The apparatus of claim 8, and further including fairing means for covering said adjustment bar extending downwardly from said frame below said leaf spring means, said fairing means including a window in one side thereof, said lateral adjustment bar extension protrudes through said window, and said window limits the longitudinal travel of said adjustment bar.

11. A stationary treadmill including a resilient suspension structure for supporting a portion of said treadmill on a surface during exercise by a user, said treadmill comprising:

a longitudinally extending treadmill frame having a first and second laterally spaced sides;

at least one longitudinally extending, substantially horizontally disposed leaf spring secured at one end to a portion of said frame and located between said first and second frame sides, said leaf spring having a second unsecured end;

foot means having a portion thereof connected to said second unsecured end of said at least one leaf spring for supporting said leaf spring above said surface; and wherein said leaf spring and said foot means secured to said second unsecured end of said leaf spring resiliently support said portion of said treadmill on said surface during said exercise by a user.

12. The apparatus of claim 11, wherein said at least one leaf spring comprises two leaf springs disposed in parallel and at a common height.

13. The apparatus of claim 12, wherein said two leaf springs are secured to common foot means.

14. The apparatus of claim 11, further including means to limit the flex of said at least one leaf spring.

15. A stationary treadmill including a resilient suspension structure for resiliently supporting a portion of said treadmill on a surface during exercise by a user, said treadmill comprising:

at least one longitudinally extending, substantially horizontally disposed leaf spring secured at one end of said frame and located between said first and second frame sides and having a second unsecured end;

spring flex limitation means comprising means to reduce the free spring length between said second unsecured end of said at least one leaf spring and a point of contact between the top of said at least one leaf spring and an adjustment element in contact with said frame; and foot means associated with said second unsecured end of said at least one leaf spring for supporting said leaf spring above said surface wherein said leaf spring and said foot means secured to said second unsecured end of said leaf spring resiliently support said portion of said treadmill on said surface during said exercise by a user.

16. The apparatus of claim 15, wherein said adjustment element comprises a longitudinally repositionable adjustment bar extending laterally between the first and second sides of said frame.

17. The apparatus of claim 16, wherein said at least one leaf spring is located below said frame, and said adjustment bar extends laterally below said frame sides and is disposed between the top of said leaf spring and the bottom of said frame.

18. The apparatus of claim 17, further including means for limiting the longitudinal travel of said adjustment means.

19. The apparatus of claim 18, wherein said adjustment bar includes an extension protruding laterally beyond one of said frame sides, the apparatus further includes a fairing extending below said frame, and said means for travel limitation comprise a window through which said adjustment bar extension protrudes.

20. The apparatus of claim 16, wherein said adjustment bar is longitudinally adjustable through rotation, and further including means for effecting rotation of said adjustment bar by a user of said treadmill.

21. A stationary resiliently mounted treadmill for use during exercise by a user, said treadmill having a portion thereof being resiliently supported by a surface upon which said treadmill rests during said exercise by a user, said treadmill comprising:

a frame including a left rail member and a right rail member spaced apart from said left rail member;

tread means interconnected between said left rail member and said right rail member configured to move during use of said treadmill for supporting a user thereon;

left foot means secured to said frame adjacent said left rail member to support said left member, said left foot means having a left leaf spring member having a length, a first end, and a second unsecured end, said left leaf spring member having the first end thereof secured to said left rail member by securing means and having said left foot means secured to said left leaf spring member along the length thereof spaced from said securing means;

a right foot means secured to said frame adjacent said right rail member to support said right rail member, said right foot means having a right leaf spring member having a length, a first end, and a second unsecured end, said right leaf spring member having the first end thereof secured to said right rail member by securing means and having said right foot means secured to said right leaf spring member along the length thereof spaced from said securing means; and wherein said left leaf spring and said foot secured to said second unsecured end of said leaf spring member and said right leaf spring and said right foot means secured to said second unsecured end of said right leaf spring member resiliently support said portion of said treadmill on said surface during said exercise by a user.

22. The apparatus of claim 21, wherein said left and right foot means are secured to a common crossmember extending transversely between said left and right frame members.

* * * * *